US007677705B2

(12) United States Patent
Ikeda

(10) Patent No.: US 7,677,705 B2
(45) Date of Patent: Mar. 16, 2010

(54) INK JET HEAD FOR PROVIDING STABLE INK DISCHARGE, METHOD OF MANUFACTURING THE INK JET HEAD, AND INK JET RECORDING DEVICE

(75) Inventor: Koji Ikeda, Hyogo (JP)

(73) Assignee: Panasonic Corporation, Osaka (JP)

( * ) Notice: Subject to any disclaimer, the term of this patent is extended or adjusted under 35 U.S.C. 154(b) by 763 days.

(21) Appl. No.: 10/599,741

(22) PCT Filed: Feb. 8, 2006

(86) PCT No.: PCT/JP2006/302189

§ 371 (c)(1),
(2), (4) Date: Oct. 6, 2006

(87) PCT Pub. No.: WO2006/085561

PCT Pub. Date: Aug. 17, 2006

(65) Prior Publication Data

US 2007/0211107 A1 Sep. 13, 2007

(30) Foreign Application Priority Data

Feb. 9, 2005 (JP) ..... 2005-032555
May 10, 2005 (JP) ..... 2005-137032

(51) Int. Cl.
*B41J 2/045* (2006.01)

(52) U.S. Cl. ..... 347/68; 347/70; 347/71

(58) Field of Classification Search ..... 347/8, 347/12, 13, 20, 37, 40, 42, 44, 45, 47, 49, 347/50, 68, 70–72
See application file for complete search history.

(56) References Cited

U.S. PATENT DOCUMENTS 5,971,522 A * 10/1999 Ono et al. ..... 347/40
2001/0020965 A1 9/2001 Fujii et al.

FOREIGN PATENT DOCUMENTS

| | | |
|---|---|---|
| CN | 1313191 | 9/2001 |
| JP | 63-74645 | 4/1988 |
| JP | 9-226106 | 9/1997 |
| JP | 2000-289191 | 10/2000 |
| JP | 2004-160875 | 6/2004 |
| JP | 2004-160875 A | 6/2004 |

OTHER PUBLICATIONS

English language Abstract of JP 63-74645, Apr. 5, 1988.
English language Abstract of JP 9-226106, Sep. 2, 1997.
English language Abstract of CN 1313191, Sep. 19, 2001.

* cited by examiner

*Primary Examiner*—Juanita D Stephens
(74) *Attorney, Agent, or Firm*—Greenblum & Bernstein, P.L.C.

(57) ABSTRACT

An ink jet head with a plurality of ink jetting units enabling the easy filling of ink and an operation for recovering from defective jetting, a method of manufacturing the ink jet head, and an ink jet recording device. The ink jet head comprises a nozzle plate in which a nozzle jetting the ink is formed, a pressure application means applying a pressure to the ink, a wall member holding the nozzle plate, a head plate holding the plurality of ink jetting units, sealing members sealing clearances between the ink jetting units and the head plate so that air is not passed there through and movably supporting the ink jetting units on the head plate by deforming by itself, and fixing members fixing the ink jetting units to the head plate.

16 Claims, 11 Drawing Sheets

INK JET HEAD FOR PROVIDING STABLE INK DISCHARGE, METHOD OF MANUFACTURING THE INK JET HEAD, AND INK JET RECORDING DEVICE

TECHNICAL FIELD

The present invention relates to an ink-jet head that discharges a liquid and a manufacturing method thereof, and an ink-jet recording apparatus.

BACKGROUND ART

In recent years, various technologies have been actively studied whereby luminous elements or filters used in displays or the like, and also microlenses or the like, are formed directly by discharging various liquids using ink-jet technology.

With such a technology whereby a device is created using ink-jet technology, performance requirements with respect to the ink-jet head are more stringent than hitherto.

One aspect of performance required of the ink jet head is impact positioning of ink drops discharged from a nozzle.

Various proposals have hitherto been made as methods of improving the impact positioning capability of the ink-jet head (see Patent Document 1 and Patent Document 2, for example).

An ink-jet head described in Patent Document 1 is equipped with a nozzle pipe provided with a nozzle that discharges ink at its tip, a piezoelectric element attached to the nozzle pipe, a head unit that holds the nozzle pipe and piezoelectric element, and a head case in which a plurality of head units are provided.

A head unit is configured so as to be freely attachable to and removable from the head case. A head unit and head case are aligned while observing the nozzle position of the tip of the nozzle pipe by means of a magnifying glass, and after alignment, are fixed by means of a screw, adhesive, or the like.

By means of this method, an ink-jet head can be provided that offers good alignment precision of a plurality of nozzles.

Meanwhile, an ink-jet recording apparatus described in Patent Document 2 improves ink drop rectilinearity and reduces satellite occurrence through a contrivance of the waveform that passes through the ink-jet head, and thereby improves impact positioning capability.

In addition to these systems, ink-jet heads have been proposed that achieve good impact positioning capability through improvement of nozzle processing precision, such as the nozzle shape and the spacing of nozzles (hereinafter referred to as "nozzle pitch"), improvement of the precision of alignment of a nozzle and pressure chamber, water-repellent film formation on the nozzle plate, and so forth.

Patent Document 1: Japanese Patent Application Laid-Open No. SHO 63-74645

Patent Document 2: Japanese Patent Application Laid-Open No. HEI 9-226106

DISCLOSURE OF INVENTION

Problems to be Solved by the Invention

With a conventional ink-jet head, normally an operation whereby ink is sucked from a nozzle is necessary when the head is first filled with ink, and later, when an operation is performed to remove contaminating air bubbles inside the ink-jet head.

The usual method of sucking ink from a nozzle is as follows. The nozzle part is cut off from the atmosphere by a cap that seals the nozzle part, and then air inside the cap is sucked out by means of a pump, negative pressure is created inside the cap, and ink is sucked from the nozzle.

However, with an above-described conventional ink-jet head, the area of the tip of a nozzle is extremely small, and it is very difficult to seal this part with a cap.

A possible method of sealing the nozzle part is to seal nozzle parts across a plurality of nozzles by means of a cap.

However, with an above-described conventional ink-jet head, no contrivance of any kind is provided for suction by means of a cap among a plurality of nozzles, and therefore when a cap is fitted and suction is performed by a pump, air seeps in from gaps between the nozzles, a sufficient degree of negative pressure cannot be achieved inside the cap, and suction of ink inside the ink jet head cannot be performed satisfactorily.

On the other hand, this kind of ink-jet head requires higher impact positioning capability in line with higher device densities, and higher impact positioning capability is also required of an above-described conventional ink-jet head.

However, with an above-described conventional ink-jet head, although considerable improvements have been made in impact positioning capability, consideration has not been given to cases in which the temperature changes.

Therefore, with an above-described conventional ink-jet head, nozzle pitch varies due to thermal expansion and contraction caused by ink-jet head temperature changes, and the desired impact positioning capability cannot be attained.

To avoid such thermal expansion and contraction due to ink-jet head temperature changes, it is desirable to maintain a constant environmental temperature at which an ink-jet recording apparatus is used, and prevent the temperature of the ink-jet head from changing.

However, a method whereby the environmental temperature at which an ink-jet recording apparatus is used is kept constant is not a satisfactory method since it entails large-scale equipment.

For this kind of ink-jet recording apparatus, a method has been proposed that makes it possible to for highly viscous ink to be discharged by having the ink-jet head actively heated to, and maintained at, a predetermined temperature, raising the temperature of ink in the ink-jet head, and lowering the viscosity of the ink.

With this type of ink-jet recording apparatus, ink-jet head temperature changes are greater, and nozzle pitch variations are also large, so that it is necessary to consider the effect of nozzle pitch variations on impact positioning capability.

It is an object of the present invention to provide an ink jet head capable of performing ink suction from a nozzle dependably when an ink jet head provided with a plurality of ink discharge units is filled with ink, and when a recovery operation is performed in the event of a discharge defect, and a manufacturing method thereof, together with an ink-jet recording apparatus with good ink drop impact positioning capability capable of constantly maintaining the nozzle pitch of the ink-jet head at a desired value.

Means for Solving the Problems

An ink-jet head of the present invention employs a configuration that includes: a nozzle plate in which a nozzle that discharges ink is formed; a pressure application section that applies pressure to ink; a nozzle plate holding member that holds the nozzle plate; a head plate that holds a plurality of ink discharge units composed of at least said nozzle plate and said pressure application section and said nozzle plate holding member; a sealing member that seals a gap between said ink discharge unit and said head plate so that air does not pass through and supports said ink discharge unit movably with respect to said head plate by itself being deformed; and a fixing member that fixes said ink discharge unit and said head plate after the gap between said ink discharge unit and the head plate is sealed by the sealing member, and alignment of said ink discharge unit with said head plate is performed.

An ink-jet head manufacturing method of the present invention is a manufacturing method of the ink-jet head wherein alignment of the ink discharge unit and the head plate is performed while discharging an ink drop from the ink discharge unit and observing a state of flight of an ink drop discharged from the ink discharge unit.

An ink-jet recording apparatus of the present invention employs a configuration that includes the ink-jet head, and a nozzle pitch detection section that detects spacing of said nozzles of said ink-jet head.

Advantageous Effect of the Invention

According to an ink-jet head and manufacturing method thereof of the present invention, ink suction from a nozzle can be performed dependably when an ink-jet head provided with a plurality of ink discharge units is filled with ink, and when a recovery operation is performed in the event of a discharge defect. Also, according to an ink-jet recording apparatus of the present invention, the nozzle pitch of the ink-jet head can be maintained constantly at a desired value, and an improvement in ink drop impact positioning capability can be achieved.

BEST MODE FOR CARRYING OUT THE INVENTION

Embodiments of the present invention will now be described with reference to the accompanying drawings.

Embodiment 1

Figure 1:
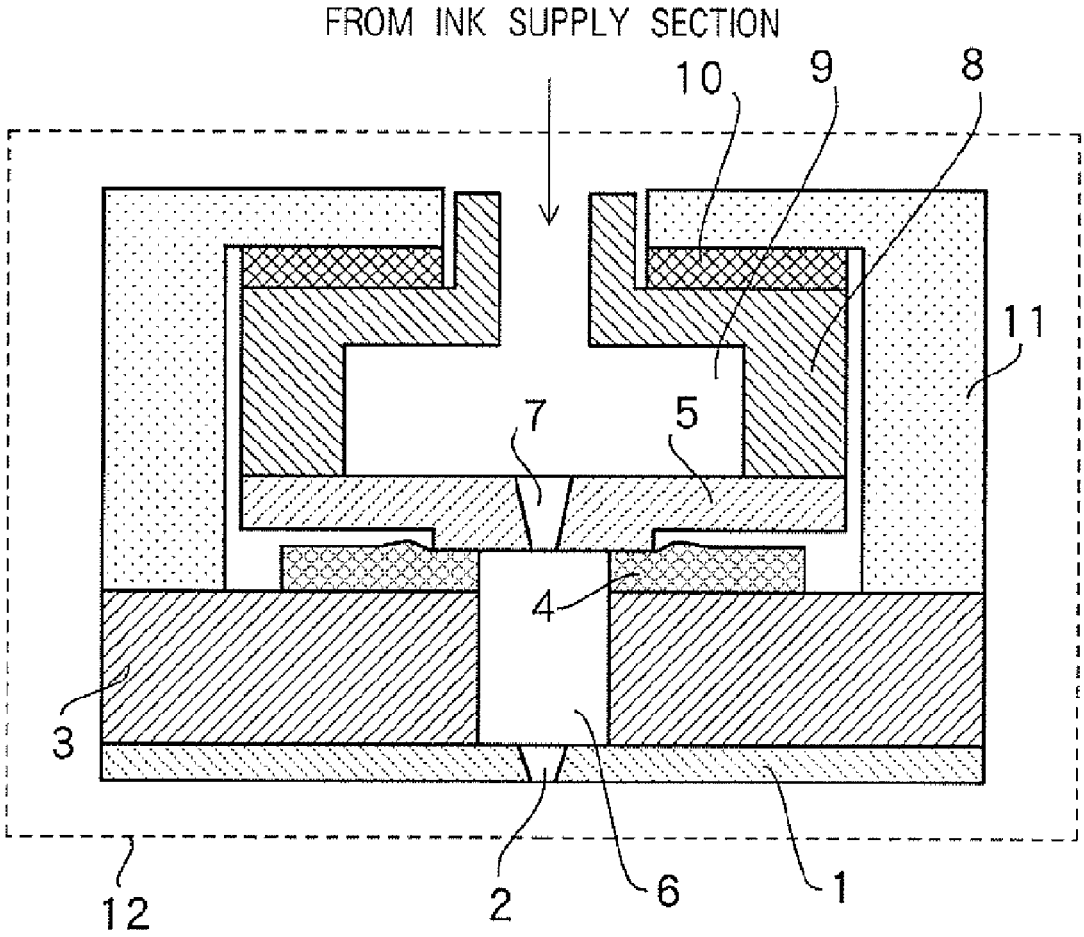
FIG. 1 is a cross-sectional diagram showing the general configuration of an ink discharge unit used in an ink-jet head according to Embodiment 1 of the present invention.

FIG. 1 is a cross-sectional diagram showing the general configuration of an ink discharge unit used in an ink-jet head according to Embodiment 1 of the present invention.

As shown in FIG. 1, an ink discharge unit 12 used in an ink-jet head of this example is composed of a nozzle plate 1, a wall member 3, an elastic member 4, a diaphragm 5, a reserve fluid chamber structure 8, a piezoelectric element 10, and a nozzle plate holding member 11.

In FIG. 1, nozzle plate 1 is of 50 μm thick stainless steel plate, with a nozzle 2 formed approximately in the center of the plate. Nozzle 2 has a tapering shape, with a bore diameter of ϕ 10 μm on the exit side and a bore diameter of ϕ 50 μm on the entry side.

Wall member 3 is of stainless material, and has a ϕ 200 μm cylindrical hole forming a pressure chamber 6 formed approximately in its center. The exit-side surface of wall member 3 is joined to the entry-side surface of nozzle plate 1.

Elastic member 4 is of approximately 10 μm thick rubber material such as silicone rubber, fluororubber, or the like. Elastic member 4 is formed on the top surface of wall member 3 where there is no hole by means of spin-coating, casting, or the like.

Diaphragm 5 is of stainless material, and is pressed against elastic member 4 by being pushed down by reserve fluid chamber structure 8. Diaphragm 5 has a projecting section on the part opposite pressure chamber 6 on the elastic member 4 side, and the thrust of the elastic member 4 is concentrated in this projecting section. Thus, diaphragm 5 improves the sealing performance of pressure chamber 6 by increasing the contact pressure against elastic member 4. Diaphragm 5 is provided with an ink supply aperture 7 forming a passage between pressure chamber 6 and a reserve fluid chamber 9.

After elastic member 4 has been formed on the top surface of wall member 3 where there is no hole, pressure chamber 6 is formed by covering a through-hole bored to the same extent in elastic member 4 and wall member 3 by means of laser processing, drilling, or the like, from the elastic member 4 side by nozzle plate 1 and diaphragm 5.

Reserve fluid chamber structure 8 is placed in contact with diaphragm 5 so as to cover ink supply aperture 7, and forms reserve fluid chamber 9 with diaphragm 5. Reserve fluid chamber 9 is linked to an ink supply section (not shown).

An electrode (not shown) is formed on piezoelectric element 10 so that an electrical field is applied. A pressure application section is configured by means of this piezoelectric element 10 and diaphragm 5.

Nozzle plate holding member 11 displaces diaphragm 5 toward wall member 3 via reserve fluid chamber structure 8 by suppressing movement of piezoelectric element 10 in the upward direction in FIG. 1. Nozzle plate holding member 11 is in contact with piezoelectric element 10 and wall member 3.

As shown in FIG. 1, with ink discharge unit 12 according to Embodiment 1, nozzle plate 1 is configured so as to be held attached indirectly to nozzle plate holding member 11 via wall member 3, but it is also possible, for example, for nozzle plate 1 to be configured so as to be held attached directly to nozzle plate holding member 11.

Next, an ink discharge operation of ink discharge unit 12 will be described.

First, ink filling is performed as follows: ink supply section (not shown)→reserve fluid chamber 9→ink supply aperture 7→pressure chamber 6→nozzle 2.

Figure 10:
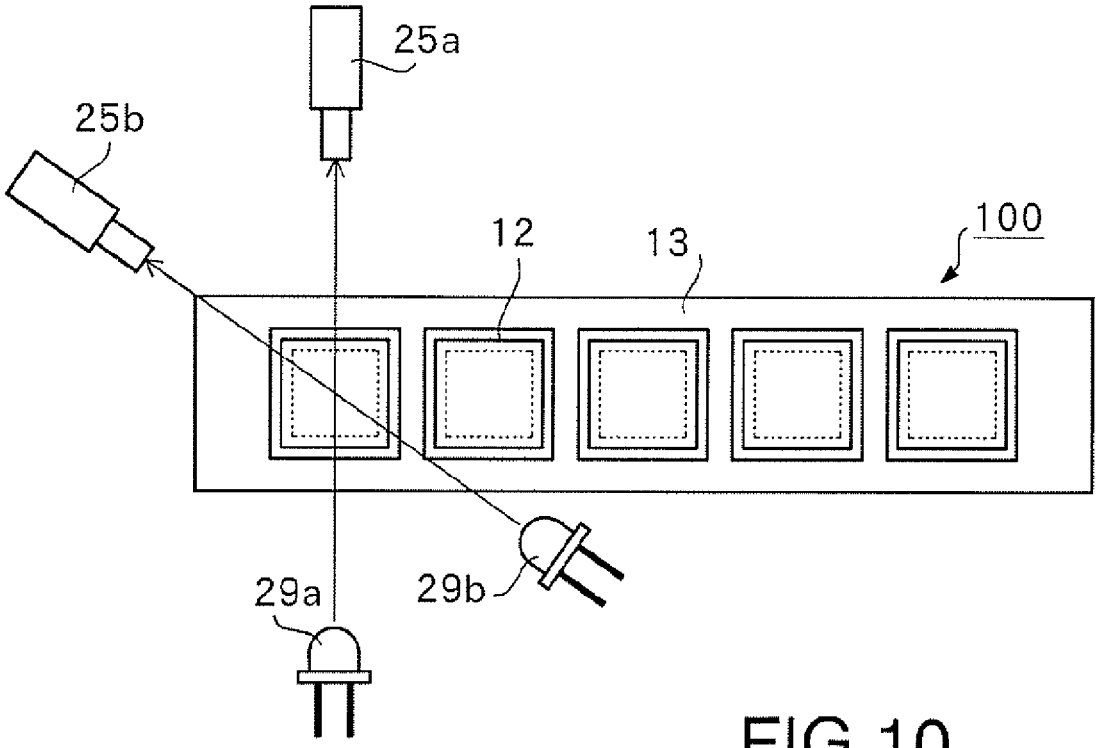
FIG. 10 is a plan view showing the manufacturing method of an ink-jet head according to Embodiment 2 of the present invention.

Next, when a predetermined voltage is applied to piezoelectric element 10, piezoelectric element 10 expands in the vertical direction in FIG. 1. As movement of piezoelectric element 10 in the upward direction in FIG. 10 is suppressed by nozzle plate holding member 11, piezoelectric element 10 cannot expand toward nozzle plate holding member 11.

Therefore, reserve fluid chamber structure 8 and diaphragm 5 move toward wall member 3 while compressing elastic member 4. Through this movement, the volume of pressure chamber 6 decreases, pressure is applied to the ink held inside pressure chamber 6, and ink is discharged from nozzle 2.

Then, when application of an electrical field to piezoelectric element 10 is canceled, expanding piezoelectric element 10 returns to its original state, and the volume of pressure chamber 6 returns to normal. At this time, ink is added to pressure chamber 6 from ink supply aperture 7, and preparations for the next ink discharge are completed.

With this ink discharge unit 12, ink was actually discharged and the droplet quantity and discharge speed were measured. When using ink with a viscosity of 50 cP, the discharge quantity was 0.3 picoliter, and the discharge speed was 8 m/sec.

Also, with this ink discharge unit 12, the voltage applied to piezoelectric element 10 was varied by ±30%, and variation of the ink drop discharge direction was observed. The result of the observation was that, within a range in which satisfactory ink drops are formed, there was no variation whatever in the ink drop discharge direction.

With a conventional ink-jet head, the discharge direction often changes slightly when the voltage applied to piezoelectric element 10 is varied. The main reason for this is that, when a voltage is applied to ink in pressure chamber 6 and nozzle 2, the pressure distribution of ink in pressure chamber 6 and nozzle 2 varies according to the magnitude of the pressure.

In contrast, in ink discharge unit 12 used in an ink-jet head of this example, the direction of relative movement of diaphragm 5 is virtually parallel to the discharge direction of an ink drop discharged from nozzle 2.

Consequently, with ink discharge unit 12 used in an ink-jet head of this example, pressure distribution in pressure chamber 6 and nozzle 2 is not prone to vary, and it has been made possible to implement a configuration whereby there is no variation in the ink drop discharge direction even if the voltage applied to piezoelectric element 10 is varied.

Figure 2:
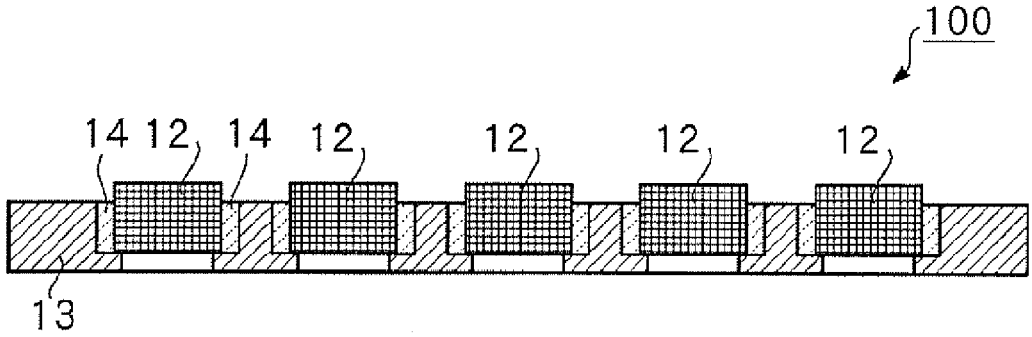
FIG. 2 is a cross-sectional diagram showing an example of the general configuration of an ink-jet head according to Embodiment 1 of the present invention.
Figure 3:
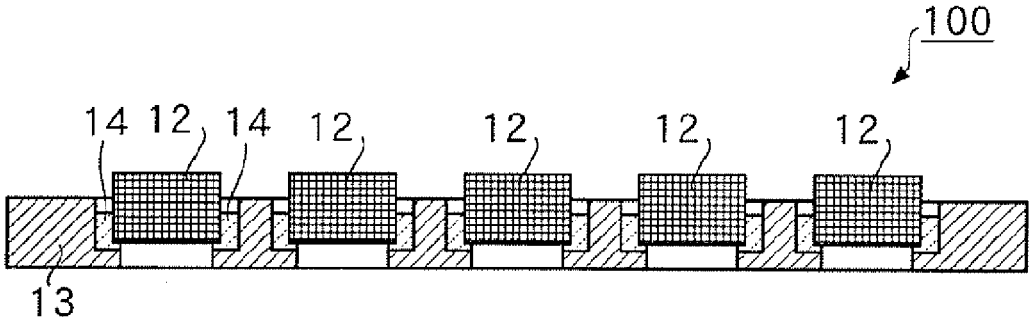
FIG. 3 is a cross-sectional diagram showing another example of the general configuration of an ink-jet head according to Embodiment 1 of the present invention.

Next, the configuration of an ink-jet head of this example provided with a plurality of ink discharge units 12 configured in this way will be described. FIG. 2 is a cross-sectional diagram showing an example of the general configuration of an ink-jet head according to Embodiment 1 of the present invention.

As shown in FIG. 2, an ink-jet head 100 of this example has a configuration whereby a plurality of ink discharge units 12 are located at predetermined spacing on a head plate 13.

In FIG. 2, recesses are formed in head plate 13 at the places where ink discharge units 12 are located, in order to make it easier to bring ink discharge units 12 closer to a receiving body 23 (see FIG. 8A) comprising a recording medium to which ink drops adhere.

Each ink discharge unit 12 is positioned so that its nozzle plate 1 is in close contact with the stepped part of the corresponding recess in head plate 13

The gaps between ink discharge units 12 and recesses in head plate 13 are sealed by means of sealing members 14. Sealing members 14 should preferably be of an elastic, highly airtight material such as silicone rubber, fluororubber, or some other rubber material, for example.

Sealing members 14 in ink-jet head 100 of this example may also be formed so as to fit between nozzle plate 1 of each ink discharge unit 12 and head plate 13.

Figure 4:
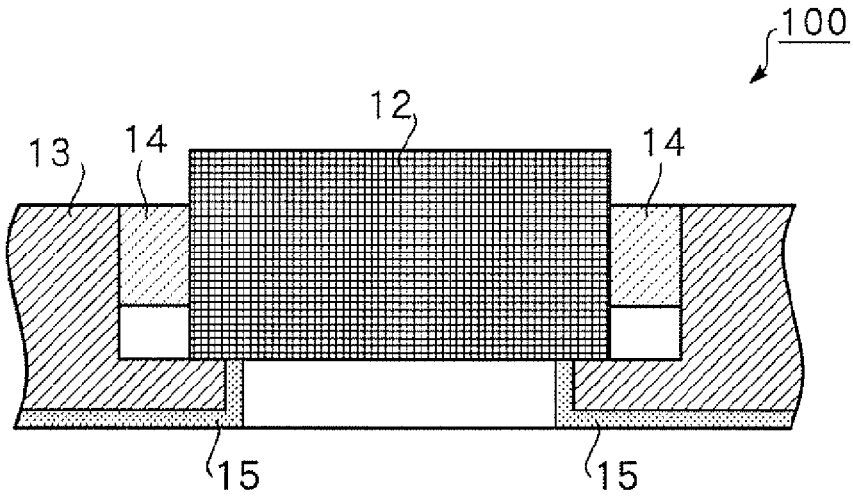
FIG. 4 is a principal-part enlarged cross-sectional diagram showing the general configuration when ink repellence processing is executed on the head plate of an ink-jet head according to Embodiment 1 of the present invention.

FIG. 4 is a principal-part enlarged cross-sectional diagram showing the general configuration when ink repellence processing is executed on the head plate of an ink-jet head according to Embodiment 1 of the present invention.

As shown in FIG. 4, for ink-jet head 100 of this example, ink repellence processing may be executed on head plate 13 to form an ink-repellent film 15.

The same kind of material as the ink-repellent film (not shown) formed on nozzle plate 1 of ink discharge unit 12 can be used satisfactorily as the material of ink-repellent film 15.

Ink-repellent film 15 on ink jet head 100 of this example is formed on both the surface of head plate 13 from which ink drops are discharged, and the wall surface of the aperture part through which ink drops pass.

Figure 5:
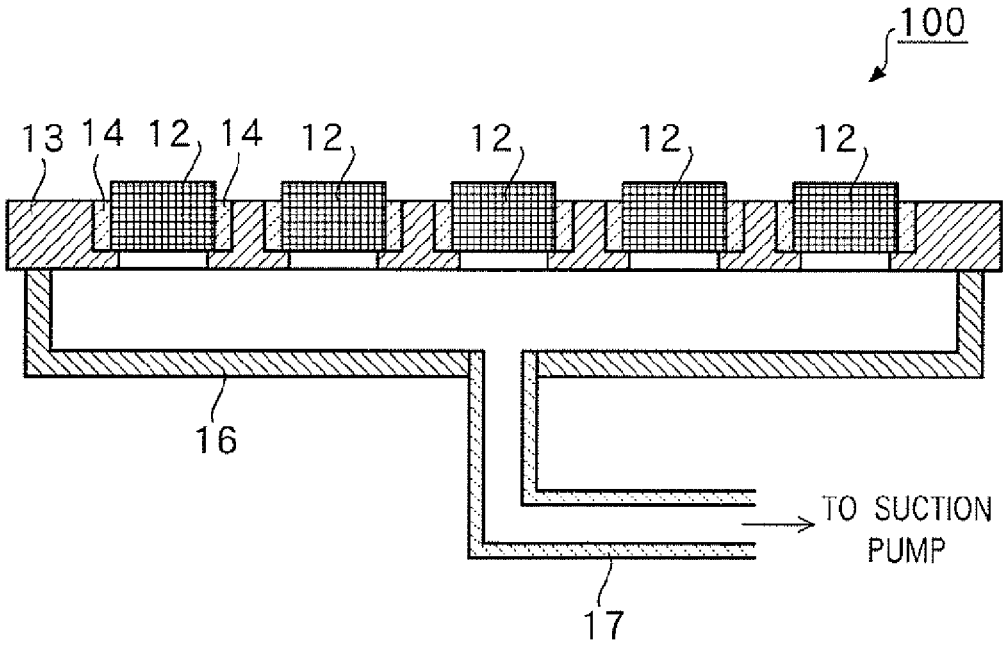
FIG. 5 is a schematic cross-sectional diagram for explaining an ink filling or similar operation for an ink-jet head according to Embodiment 1 of the present invention.

Next, an operation such as ink filling in ink-jet head 100 of this example will be described FIG. 5 is a schematic cross-sectional diagram for explaining an ink filling or similar operation for an ink-jet head according to Embodiment 1 of the present invention.

As shown in FIG. 5, when ink filling or the like is performed for ink discharge units 12 of ink-jet head 100 of this example, a suction cap 16 is brought into close contact with head plate 13 so as to cover the ink discharge surfaces of ink discharge units 12.

In FIG. 5, suction cap 16 is formed from a rubber material with good adherence to head plate 13, and is connected to a suction pump (not shown) via a tube 17.

Filling ink discharge units 12 of ink-jet head 100 with ink and so forth is performed by sucking air from inside tube 17 by means of the suction pump while suction cap 16 is tightly adhering to head plate 13.

In ink-jet head 100, since gaps between ink discharge units 12 and the recesses in head plate 13 are sealed by sealing members 14, air does not leak from these gaps when suction is performed by the suction pump.

Therefore, with ink-jet head 100 of this example, negative pressure inside suction cap 16 can be increased satisfactorily, and ink filling and so forth can be carried out satisfactorily.

Figure 6:
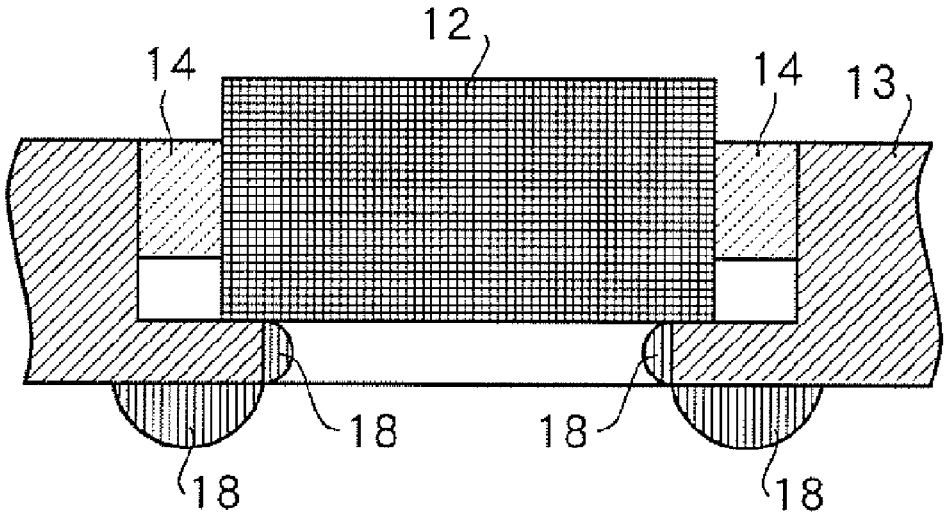
FIG. 6 is a schematic cross-sectional diagram showing the state after an ink filling operation is performed when an ink-repellent film of an ink-jet head according to Embodiment 1 of the present invention has not been formed.

Next, the state will be described after an ink filling operation has been performed when ink-repellent film 15 has not been formed on head plate 13. FIG. 6 is a schematic cross-sectional diagram showing the state after an ink filling operation is performed when an ink-repellent film of an ink-jet head according to Embodiment 1 of the present invention has not been formed.

The result of an ink filling experiment conducted when ink-repellent film 15 had not been formed on head plate 13 was that, as shown in FIG. 6, ink blobs 18 tended to form at the ink discharge locations of head plate 13.

With this kind of ink-jet head, if ink blobs 18 formed on head plate 13 impinge on nozzle 2 of an ink discharge unit 12, an ink drop discharge defect will occur.

With this kind of ink-jet head, even if ink blobs 18 do not impinge on nozzle 2, hardening or increased viscosity will occur when ink blobs 18 dry, and if these should clog nozzle 2 for some reason, blockage of nozzle 2 will occur, and ink drop discharge will be prevented.

In contrast, with ink-jet head 100 of this example, since ink-repellent film 15 is formed on head plate 13 as shown in FIG. 4, occurrences of ink blobs 18 can be kept to a very small number compared with a case in which ink-repellent film 15 is not formed on head plate 13, as shown in FIG. 6.

Figure 7:
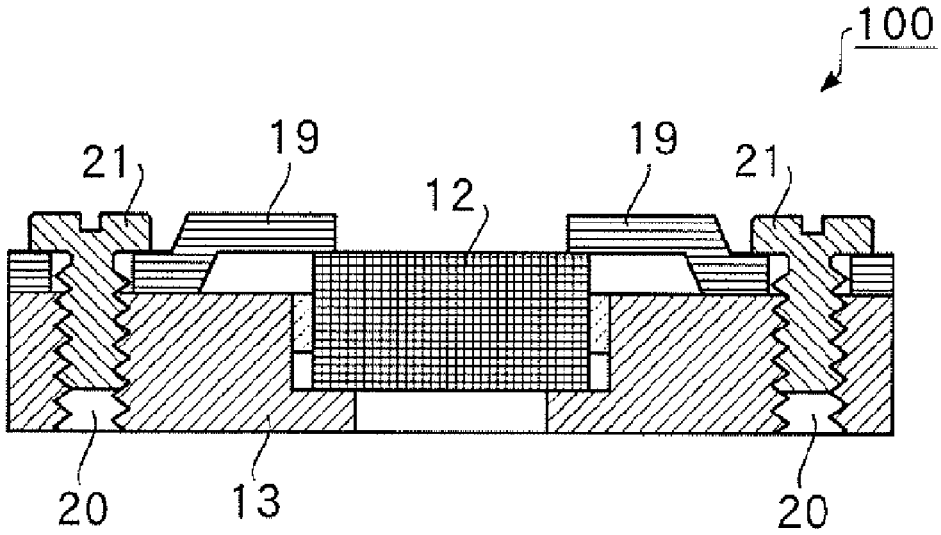
FIG. 7 is a side view showing a method of fixing an ink discharge unit to a head plate of an ink-jet head according to Embodiment 1 of the present invention.

Next, the manufacturing method of ink-jet head 100 of this example will be described. FIG. 7 is a side view showing a method of fixing an ink discharge unit to a head plate of an ink-jet head according to Embodiment 1 of the present invention.

In FIG. 7, leaf springs 19 are positioned so as to press nozzle plate holding member 11 (see FIG. 1) of ink discharge unit 12 against head plate 13.

Screw-holes 20 are formed in head plate 13, and leaf springs 19 are fixed to head plate 13 by means of screws 21.

By this means, ink discharge unit 12 is fixed to head plate 13 so that its nozzle plate 1 is positioned on the ink discharge surface side.

Silicone rubber used for sealing member 14 is formed in (fills) the gap between ink discharge unit 12 and head plate 13 after ink discharge unit 12 is fixed to head plate 13 with screws 21.

With ink-jet head 100 of this example, since ink discharge unit 12 is fixed to head plate 13 with screws 21, and sealing member 14 is formed from elastic silicone rubber, ink-jet head 100 has a structure that allows ink discharge unit 12 to be removed from head plate 13.

Figure 8A:
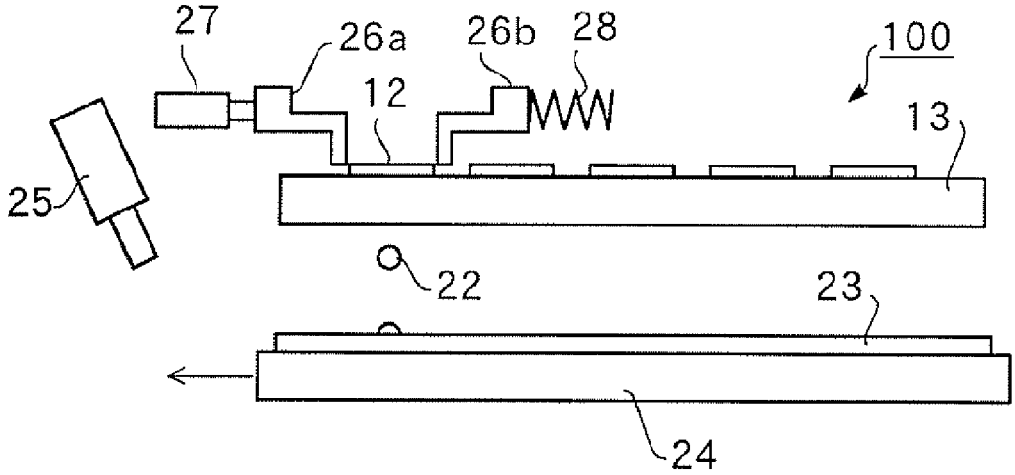
FIG. 8A is a front view showing a method of alignment of an ink discharge unit of an ink-jet head with a head plate according to Embodiment 1 of the present invention.
Figure 8B:
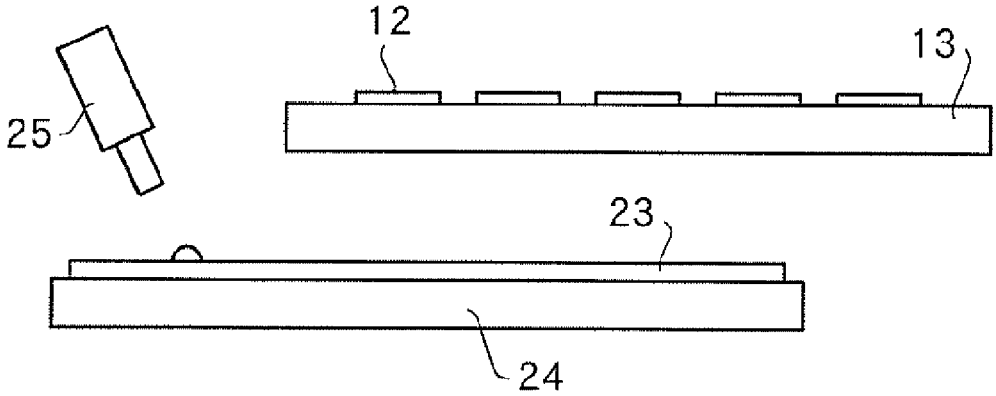
FIG. 8B is a front view showing a correction method for the displacement amount at the time of alignment of an ink discharge unit of an ink-jet head with a head plate according to Embodiment 1 of the present invention.

Next, the method of aligning ink discharge unit 12 with head plate 13 will be described. FIG. 8A is a front view showing a method of alignment of an ink discharge unit of an ink-jet head with a head plate according to Embodiment 1 of the present invention, and FIG. 8B is a front view showing a correction method for the displacement amount at the time of alignment of an ink discharge unit of an ink-jet head with a head plate according to Embodiment 1 of the present invention.

In FIG. 8A, an ink drop 22 is discharged toward receiving body 23 from nozzle 2 (see FIG. 1) of ink discharge unit 12 of ink-jet head 100. Receiving body 23 is held by a movable stage 24 so as to be able to move in the direction indicated by the arrow.

Above the path of movement of receiving body 23, a camera 25 is positioned in order to observe the recorded image of ink drop 22 formed on receiving body 23.

Ink discharge unit 12 of ink-jet head 100 is sandwiched between a pair of levers 26*a* and 26*b*. One lever 25*a* is supported in a movable fashion by a micrometer 27, and the other lever 26*b* is supported in a movable fashion via a spring 28.

In this way, ink discharge unit 12 is supported so as to be able to be fixed in a desired position by means of lever 26*a*, lever 26*b*, micrometer 27, and spring 28. Although not shown in the figure in order to simplify the explanation, a set of lever 26*a*, lever 26*b*, micrometer 27, and spring 28 is also provided in a direction perpendicular to the direction of the row of ink discharge units 12, and movement of ink discharge unit 12 is also possible in this direction.

To perform alignment of ink discharge unit 12 with head plate 13, first, screws 21 shown in FIG. 7 are tightened, fixing ink discharge unit 12 to head plate 13, and in this state an ink drop 22 is discharged toward receiving body 23 from nozzle 2 of ink discharge unit 12.

Next, movable stage 24 is moved to a position in which the recorded image of ink drop 22 formed on receiving body 23 can be observed by camera 25, as shown in FIG. 8B. Then the amount of displacement from the desired position of the recorded image of ink drop 22 formed on receiving body 23 is ascertained by means of camera 25.

To correct this amount of displacement, screws 21 are loosened so that ink discharge unit 12 can be moved, micrometer 27 is rotated and the position of ink discharge unit 12 relative to head plate 13 is shifted, and then screws 21 are tightened again.

By repeating this procedure, alignment of ink discharge unit 12 with head plate 13 can be performed satisfactorily.

As ink discharge unit 12 sealing member 14 is formed from elastic silicone rubber, movement of ink discharge unit 12 is facilitated when moved relative to head plate 13, and a sealed state can be maintained after the move.

Ink drops 22 were actually discharged using an ink jet head 100 equipped with five ink discharge units 12, and the impact positions of ink drops 22 on receiving body 23 were measured.

The results showed that the situation regarding impact on receiving body 23 with this method of aligning ink discharge units 12 with head plate 13 is extremely good, and it was possible to implement an ink-jet head 100 with an error from the desired impact position of ±5 μm.

As described above, in ink-jet head 100 of this example, air can be prevented from passing through gaps between ink discharge units 12 and head plate 13 by sealing those gaps with sealing members 14.

Therefore, with ink-jet head 100 of this example, it is possible for adequate negative pressure to be applied to ink inside ink discharge unit 12 by sucking air from nozzle 2 while suction cap 16 is not in direct contact with nozzle plate 1 but is in contact with head plate 13.

Consequently, with ink-jet head 100 of this example, filling of ink discharge unit 12 with ink, and recovery in the event of a discharge defect caused by nozzle 2 of ink discharge unit 12, can be performed satisfactorily, and stable ink discharge is possible.

In ink-jet head 100 of this example, ink discharge unit 12 is supported so as to be able to move relative to head plate 13 through the deformation of sealing member 14 made of an elastic material.

Therefore, with ink-jet head 100 of this example, it is possible to move ink discharge unit 12 by a small amount relative to head plate 13 while a sealed state is maintained even after sealing member 14 is formed.

In ink-jet head 100 of this example, ink discharge unit 12 is fixed to head plate 13 in an attachable and removable fashion.

Therefore, with ink-jet head 100 of this example, even after alignment has once been performed, it is possible to carry out removal and realignment.

With ink-jet head 100 of this example, it is possible to replace ink discharge unit 12 if an ink drop 22 discharge defect or ink drop 22 non-discharge occurs.

Thus, ink-jet head 100 of this example enables flexibility at the time of assembly, and maintainability, to be improved.

With ink-jet head 100 of this example, since ink repellence processing has been performed by means of ink-repellent film 15 on the surface of head plate 13 on the side on which ink is discharged, ink tends not to adhere in the vicinity of head plate 13 and nozzle 2.

Consequently, with ink-jet head 100 of this example, it seldom happens that ink adhering to and coagulating on head plate 13 moves to nozzle 2 and causes blockage of nozzle 2, and ink can be discharged in a stable fashion.

With ink-jet head 100 of this example, since ink repellence processing has also been performed by means of ink-repellent film 15 on an aperture part of head plate 13 through which ink drops 22 pass, ink also tends not to adhere to the wall surface of an aperture part of head plate 13, and ink can be discharged in a stable fashion.

A pressure application section in ink-jet head 100 of this example is composed of diaphragm 5 that moves relative to nozzle plate 1 and piezoelectric element 10 that drives diaphragm 5, and the direction of relative movement of diaphragm 5 is virtually parallel to the discharge direction of an ink drop 22 discharged from nozzle 2.

Since ink-jet head 100 of this example uses piezoelectric element 10 in the pressure application section in this way, flexibility with regard to ink selection is improved.

With ink-jet head 100 of this example, since the direction of oscillation of diaphragm 5 is virtually parallel to the ink drop 22 discharge direction, variation of the rectilinearity of an ink drop 22 can be kept small even if the intensity of the pressure applied to the ink is changed, for instance.

In the manufacturing method of ink-jet head 100 of this example, an ink drop 22 is discharged from ink discharge unit 12 onto receiving body 23, and alignment of ink discharge unit 12 and head plate 13 is carried out while observing the impact position of discharged ink drop 22 with camera 25.

Thus, in the manufacturing method of ink-jet head 100 of this example, since alignment of ink discharge unit 12 and head plate 13 is carried out while confirming the final impact position of an ink drop 22 on receiving body 23 with camera 25, ink drop 22 impact position error can be made extremely small.

In ink-jet head 100 of this example, the use of a single-layer piezoelectric element 10 has been shown as an example, but a laminated configuration may also be used for piezoelectric element 10.

A so-called electrostatic actuator using electrostatic force, or a magnetostrictor using magnetic force, may also be used as a pressure application section.

In ink-jet head 100 of this example, discharge of ink drops 22 from nozzle 2 of ink discharge unit 12 has been described as an example, but the liquid discharged from nozzle 2 of ink discharge unit 12 need not be a liquid containing a black or colored coloring material for creating text or a photograph on recording paper, and, for example, a liquid containing electrically conductive particles for electrode formation, a luminescent material used for EL (electroluminescence), a resinous material for creating microlenses, and so forth, can also be used satisfactorily.

With ink-jet head 100 of this example, a configuration in which each ink discharge unit 12 is equipped with one nozzle 2 has been described as an example, but the number of nozzles 2 need not necessarily be one. However, when particular importance is placed on variance of ink drop 22 impact positions, the fewer nozzles 2 there are, the better.

EMBODIMENT 2

Figure 9:
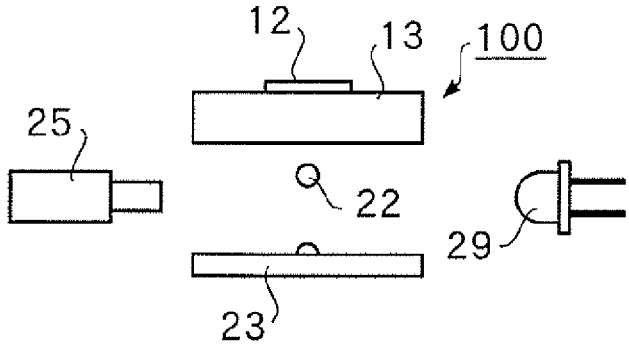
FIG. 9 is a front view showing the manufacturing method of an ink-jet head according to Embodiment 2 of the present invention.

Next, the manufacturing method of an ink-jet head according to Embodiment 2 of the present invention will be described. FIG. 9 is a front view showing the manufacturing method of an ink-jet head according to Embodiment 2 of the present invention, and FIG. 10 is a plan view showing the manufacturing method of an ink-jet head according to Embodiment 2 of the present invention. In FIG. 9 and FIG. 10, the same codes are used for configuration elements that are the same as in ink-jet head 100 according to Embodiment 1 of the present invention, and descriptions thereof are omitted.

In the manufacturing method of ink-jet head 100 of this example, the method of observing the state of flight of an ink drop 22 when discharged from an ink discharge unit 12 differs from that in the manufacturing method of ink-jet head 100 according to Embodiment 1.

As shown in FIG. 9, in the manufacturing method of ink-jet head 100 of this example, first, ink drops 22 are discharged consecutively in a fixed cycle, and an LED (light emitting diode) 29 is turned on for a short time in synchronization with this discharge cycle.

Then, in the manufacturing method of ink-jet head 100 of this example, the state of flight of an ink drop 22 is observed by observing the shadow of ink drop 22 by means of camera 25.

By confirming the state of flight of an ink drop 22 as described above in the manufacturing method of ink-jet head 100 of this example, it is possible to obtain not only the result after the impact of ink drop 22 on receiving body 23, but also information such as the ink drop 22 satellite occurrence situation, discharge speed, flight direction, and so forth.

In the ink-jet head 100 manufacturing method shown in FIG. 10, an ink discharge unit 12 is deployed with respect to head plate 13 so that the discharge state of an ink drop 22 is observed from two directions using two cameras 25*a* and 25*b* and two LEDs 29*a* and 29*b*.

When ink drop 22 is aligned with head plate 13, 3-directional (3-dimensional) alignment is normally essential, but with ink-jet head 100 of this example, since nozzle plate 1 is in intimate contact with head plate 13, with regard to the discharge direction of ink drop 22, it is sufficient to perform alignment in the remaining two directions parallel to head plate 13.

Thus, in the manufacturing method of ink-jet head 100 of this example, the first ink drop 22 discharge direction is observed by the camera 25*a*/LED 29*a* pair, and the second ink drop 22 discharge direction is observed by the camera 25*b*/LED 29*b* pair.

A method whereby the ink drop 22 discharge direction is observed from two directions—parallel to and perpendicular to the direction of the row of ink discharge units 12—using two pairs of cameras 25*a* and 25*b* and LEDs 29*a* and 29*b* in this way has traditionally been generally employed.

However, since cameras have a focal length, as is commonly known, if the length of head plate 13 in the direction of the row of ink discharge units 12 is greater than the focal length of the cameras, it is not possible to position camera 25*b* and LED 29*b* in a direction parallel to the direction of the row of ink discharge units 12.

Thus, as shown in FIG. 10, in the manufacturing method of ink-jet head 100 of this example, camera 25*b* and LED 29*b* are positioned at an angle to the direction of the row of ink discharge units 12.

Thus, in the manufacturing method of ink-jet head 100 of this example, the discharge direction of an ink drop 22 is observed from two directions by means of camera 25*a* positioned Perpendicular to the direction of the row of ink discharge units 12, and camera 25*b* positioned at an angle to the direction of the row of ink discharge units 12.

Therefore, in the manufacturing method of ink-jet head 100 of this example, the focal length of camera 25*b* does not exceed the length of head plate 13 in the direction of the row of ink discharge units 12, and good alignment between an ink discharge unit 12 and head plate 13 is possible.

As described above, in the manufacturing method of ink-jet head 100 of this example, alignment of an ink discharge unit 12 with head plate 13 is performed while discharging ink drops 22 from ink discharge unit 12.

Therefore, with the manufacturing method of ink-jet head 100 of this example, the final impact position of an ink drop 22 can be confirmed, and it is also possible to perform alignment of ink discharge unit 12 with respect to head plate 13 while confirming the state of flight, including the satellite occurrence situation, discharge speed, and so forth.

Thus, with the manufacturing method of ink-jet head 100 of this example, it is possible to prevent the installation on head plate 13 of an ink discharge unit 12 whose ink drop 22 discharge status is defective or unstable, and to obtain an ink-jet head 100 with more stable ink drop 22 impact positioning capability.

In the manufacturing method of ink-jet head 100 of this example, camera 25*a* and LED 29*a* may also be positioned at an angle to the direction of the row of ink discharge units 12.

Embodiment 3

Figure 11:
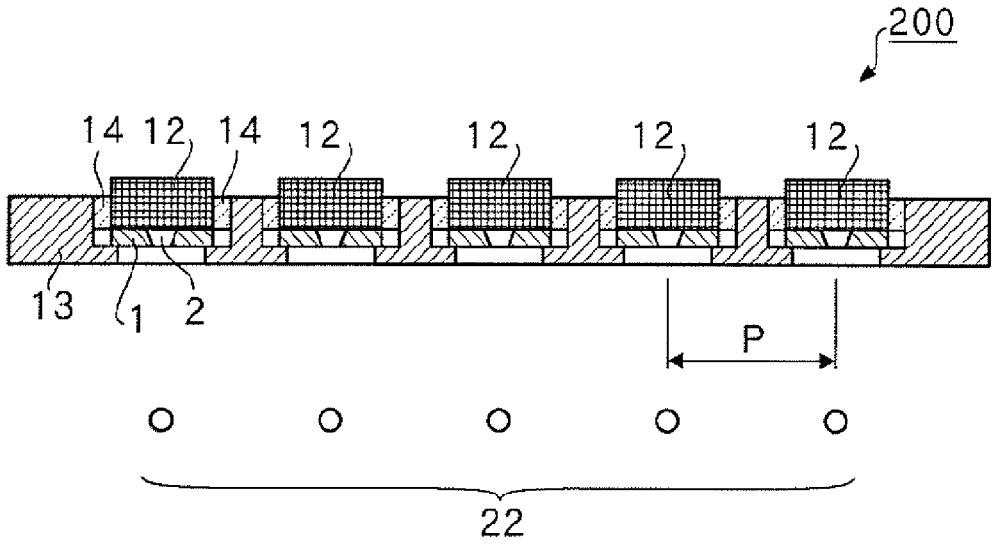
FIG. 11 is a cross-sectional diagram showing the general configuration of an ink-jet head according to Embodiment 3 of the present invention.
Figure 12:
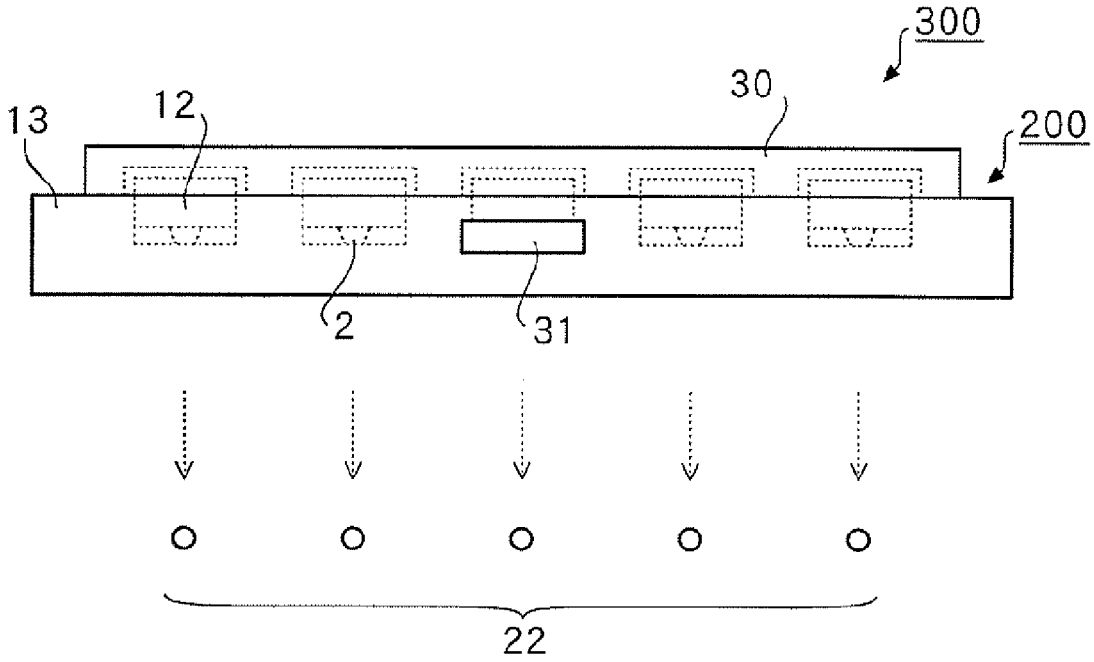
FIG. 12 is a front view showing the general configuration of an ink-jet recording apparatus that uses an ink-jet head according to Embodiment 3 of the present invention.

Next, the configuration of an ink-jet head according to Embodiment 3 of the present invention will be described. FIG. 11 is a cross-sectional diagram showing the general configuration of an ink-jet head according to Embodiment 3 of the present invention, and FIG. 12 is a front view showing the manufacturing method of an ink-jet head according to Embodiment 3 of the present invention. In FIG. 11 and FIG. 12, the same codes are used for configuration elements that are the same as in ink-jet head 100 according to Embodiment 1, and descriptions thereof are omitted.

As shown in FIG. 11, a plurality of ink discharge units 12 in an ink-jet head 200 of this example are positioned so that spacing P is a uniform distance of 25.4 mm when the temperature of head plate 13 is 50° C.

For the sake of clarity, ink-jet head 200 of this example is shown in FIG. 11 as having six ink discharge units 12, but ink-jet head 200 actually has 11 ink discharge units 12, and is formed so that the distance between nozzles at each end (the nozzle pitch) is 25.4 mm.

The method of fixing ink discharge units 12 to head plate 13 in ink-jet head 200 of this example is similar to that in ink-jet head 100 according to Embodiment 1, and therefore a description thereof will be omitted here.

The method of aligning an ink discharge unit 12 with head plate 13 in ink-jet head 200 of this example is also similar to that in ink-jet head 100 according to Embodiment 1, and therefore a description thereof will be omitted here.

Next, the general configuration of an ink jet recording apparatus that uses ink-jet head 200 of this example will be described. FIG. 12 is a front view showing the general configuration of an ink-jet recording apparatus that uses an ink-jet head according to Embodiment 3 of the present invention.

In ink-jet recording apparatus 300 shown in FIG. 12, ink-jet head 200 shown in FIG. 11 (FIG. 12 shows only a plurality of ink discharge units 12 and head plate 13) is equipped with a heater 30 as a temperature changing section and a thermistor 31 for detecting the temperature of the ink-jet head, both located on head plate 13.

In FIG. 12, a metal plate is used for head plate 13 From the standpoint of rigidity and thermal conductivity, and in ink-jet recording apparatus 300 of this example an aluminum plate is used, since aluminum is a metal with particularly good thermal conductivity.

Heater 30 generates heat through the passage of electric current, and a plane heater that is in contact with the surface of head plate 13 is used to facilitate the transfer of heat to head plate 13. Heater 30 may also be embedded in head plate 13 to further improve heat transfer.

Heater 30 heats and maintains the temperature of head plate 13 in accordance with the temperature detected by thermistor 31 fitted to head plate 13, and by this means ink discharge units 12 are heated to and maintained at a desired temperature.

Next, the operation of ink-jet recording apparatus 300 of this example will be described.

In ink-jet recording apparatus 300 of this example, first, current is passed through heater 30 in accordance with the temperature detected by thermistor 31, and head plate 13 is heated to and maintained at the desired temperature.

Figure 13:
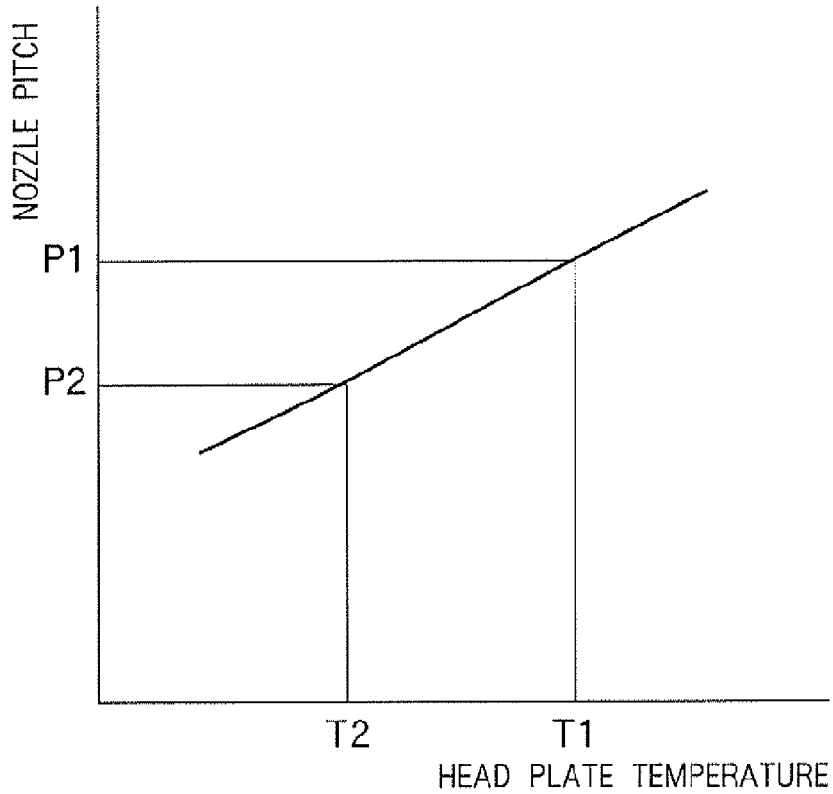
FIG. 13 is a graph showing the relationship between ink-jet head temperature and nozzle pitch according to Embodiment 3 of the present invention.

FIG. 13 is a graph showing the relationship between ink-jet head temperature and nozzle pitch according to Embodiment 3 of the present invention. As shown in FIG. 13, when the temperature of head plate 13 rises, the nozzle pitch increases due to thermal expansion.

That is to say, as shown in FIG. 13, when the temperature of head plate 13 is T2 and the nozzle pitch at that temperature T2 is P2, if the temperature of head plate 13 is raised from T2 to T1, the nozzle pitch increases to P1 due to thermal expansion.

With ink-jet recording apparatus 300 of this example, aluminum is used for head plate 13, and its coefficient of linear thermal expansion is $23.9\times10E^{-6}/°$ C.

Therefore, when the temperature of head plate 13 rises by 20° C. from a reference temperature, for example, the nozzle pitch increases by 0.0478%. That is to say, since the distance between both ends of the row of nozzles 2 is 25.4 mm, that distance increases by 12 μm, and the impact position error is considerable.

Thus, with ink-jet recording apparatus 300 of this example, if the temperature of head plate 13 during use is designated T1, and the desired nozzle pitch at that temperature is designated P1, ink-jet head 200 is made so that at a temperature lower than T1—for example, T2—the nozzle pitch is P2.

Also, with ink-jet recording apparatus 300 of this example, temperature T1 during use is made higher than the temperature inside the apparatus and the operating environment temperature. That is to say, it is sufficient to provide a heating section for making the head plate 13 temperature T1, and a cooling section is not necessary.

Therefore, in ink-jet recording apparatus 300 of this example, in specific terms, an ink-jet head 200 with a desired nozzle pitch of 2.54 mm is obtained by making the head plate 13 temperature 50° C.

With this ink-jet head 200, ink drops 22 can be discharged with the desired pitch by passing current through piezoelectric element 10 (see FIG. 1) of ink discharge units 12 after the nozzle pitch has reached the desired value.

Here, in ink-jet head 200, the temperature of head plate 13 is assumed to be 50° C., and at this time the ink inside an ink discharge unit 12 also rises in temperature, and the viscosity of the ink decreases. Therefore, with this ink-jet head 200, the desired pressure is applied by passing an energizing waveform appropriate to the viscosity of the ink through piezoelectric element 10.

In this state, nozzle pitch measurement was carried out while varying the environmental temperature in which ink-jet recording apparatus 300 is used from 10° C. to 40° C. The result was that a fixed pitch of 25.4 mm could be obtained at all times by maintaining the temperature of head plate 13 at 50° C. even though the operating environment of ink-jet recording apparatus 300 was varied from 10° C. to 40° C. As the actual pitch measurement, the distance between nozzles 2 at each end was measured.

Ink-jet head 200 used in ink-jet recording apparatus 300 of this example has a configuration whereby a plurality of ink discharge units 12 are fixed to head plate 13 after being positioned, and therefore has good ink drop 22 impact positioning capability.

With ink-jet recording apparatus 300 of this example, when nozzle pitch P of ink-jet head 200 has not attained a desired value, if the environmental temperature and apparatus temperature vary from the initially set temperature and nozzle pitch P differs from the desired value, it is possible to change the temperature of head plate 13 of ink-jet head 200 by means of a temperature changing section and correct nozzle pitch P to the desired value, the desired nozzle pitch P can always be obtained, and good ink drop 22 impact positioning capability can be maintained.

As the temperature changing section in ink-jet recording apparatus 300 of this example, heater 30 that generates heat through the passage of electric current and is attached to head plate 13 is used, and through the extremely simple means of heater 30, and the ability to directly heat head plate 13 which is to be heated, temperature changes are effected speedily, and the desired nozzle pitch P is obtained, at low cost.

Ink discharge units 12 in ink-jet recording apparatus 300 are fixed to head plate 13 in an attachable and removable fashion, and readjustment of an ink discharge unit 12 can be carried out after initial alignment if required since ink discharge units 12 are attachable and removable.

Also, it is possible to replace an ink discharge unit 12 if an ink drop 22 discharge defect or ink drop 22 non-discharge occurs. Thus, an ink-jet head 200 can be provided that offers a high degree of flexibility and maintainability.

In ink-jet recording apparatus 300 of this example, through the provision of sealing member 14, it is possible to perform suction from nozzle 2, and apply negative pressure to ink in ink discharge unit 12, in a state in which suction cap 16 is in contact with head plate 13 but is not in direct contact with nozzle plate 1. Consequently, ink filling and recovery from a non-discharge state can easily be carried out while maintaining good ink drop 22 impact positioning capability.

Sealing member 14 is elastic, ink discharge unit 12 is supported so as to be able to move with respect to head plate 13 through deformation of sealing member 14, and slight movement of ink discharge unit 12 relative to head plate 13 is possible while maintaining a sealed state even after sealing member 14 is formed, enabling slight adjustment of the mounting position of ink discharge unit 12 with respect to head plate 13 to be carried out easily.

In ink-jet recording apparatus 300 of this example, one nozzle 2 is formed in one ink discharge unit 12, and if a plurality of nozzles 2 are provided, as long as alignment can be performed dependably for each ink discharge unit 12 without the occurrence of error with respect to the impact position among that plurality of nozzles, impact position error can be made extremely small.

The pressure application section of ink-jet recording apparatus 300 of this example is composed of diaphragm 5 that moves relative to nozzle plate 1, and piezoelectric element 10 that drives diaphragm 5, with the direction of relative movement of diaphragm 5 being virtually parallel to the discharge direction of an ink drop 22 discharged from nozzle 2, and flexibility with regard to ink selection is improved by using piezoelectric element 10 in the pressure application section.

In ink-jet head 300 of this example, by making the direction of oscillation of diaphragm 5 virtually parallel to the ink drop 22 discharge direction, variation of the rectilinearity of an ink drop 22 can be kept small even if the intensity of the pressure applied to the ink is changed, for instance.

According to a manufacturing method of ink-jet recording apparatus 300 of this example, alignment of an ink discharge unit 12 and head plate 13 is performed while recording an ink drop 22 from ink discharge unit 12 on receiving body 23 and observing the impact position of that ink drop 22, and with this method ink discharge unit 12 alignment is performed while confirming the final impact position, enabling impact position error to be made extremely small.

According to a manufacturing method of ink-jet recording apparatus 300 of this example, the temperature of head plate 13 during use is T1, the desired nozzle pitch of nozzles 2 of head plate 13 at that temperature T1 is P1, and when the temperature of head plate 13 is changed to T2, the head plate 13 nozzle pitch at that temperature changes to P2. That is to say, for head plate 13, when the temperature is T2, the nozzle 2 nozzle pitch is P2.

Therefore, in a manufacturing method of ink-jet recording apparatus 300 of this examples nozzle pitch P is determined taking the thermal expansion and contraction of head plate 13 into consideration, and by manufacturing ink-jet head 200 so that this determined nozzle pitch P is achieved, an ink-jet head 200 can be provided in which the desired nozzle pitch P is achieved at the temperature at which ink-jet head 200 is actually used.

In ink-jet recording apparatus 300 of this example, a single-layer piezoelectric element 10 has been used, but a laminated configuration may also be used for the piezoelectric element.

A so-called electrostatic actuator using electrostatic force, or a magnetostrictor using magnetic force, may also be used as a pressure application section in ink-jet recording apparatus 300 of this example.

In ink-jet recording apparatus 300 of this example, each ink discharge unit 12 is equipped with one nozzle 2, but the number of nozzles 2 need not necessarily be one. However, when particular importance is placed on variance of ink drop 22 impact positions, the fewer nozzles 2 there are, the better.

In ink-jet recording apparatus 300 of this example, heater 30 is attached to head plate 13 as a temperature changing section, but a heating element may also be formed directly on head plate 13.

In ink-jet recording apparatus 300 of this example, heater 30 is attached to a supporting plate 3, but heater 30 need not necessarily be attached to supporting plate 3, and it is also possible for heater 30 to be attached to ink discharge unit 12.

In ink-jet recording apparatus 300 of this example, heater 30 that generates heat through the passage of electric current is used as a temperature changing section, but it is also possible to use a cooling section that absorbs heat by means of a Peltier element or the like, for example, and furthermore a configuration is also possible in which both heater 30 and a cooling section are used.

In ink-jet recording apparatus 300 of this example, the liquid sucked from ink-jet head 100 has been assumed to be ink, but this liquid need not be a liquid containing a black or colored coloring material for creating text or a photograph on recording paper, and, for example, a liquid containing electrically conductive particles for electrode formation, a luminescent material used for EL (electroluminescence), a resinous material for creating microlenses, and so forth, can also be used satisfactorily.

Embodiment 4

Figure 14:
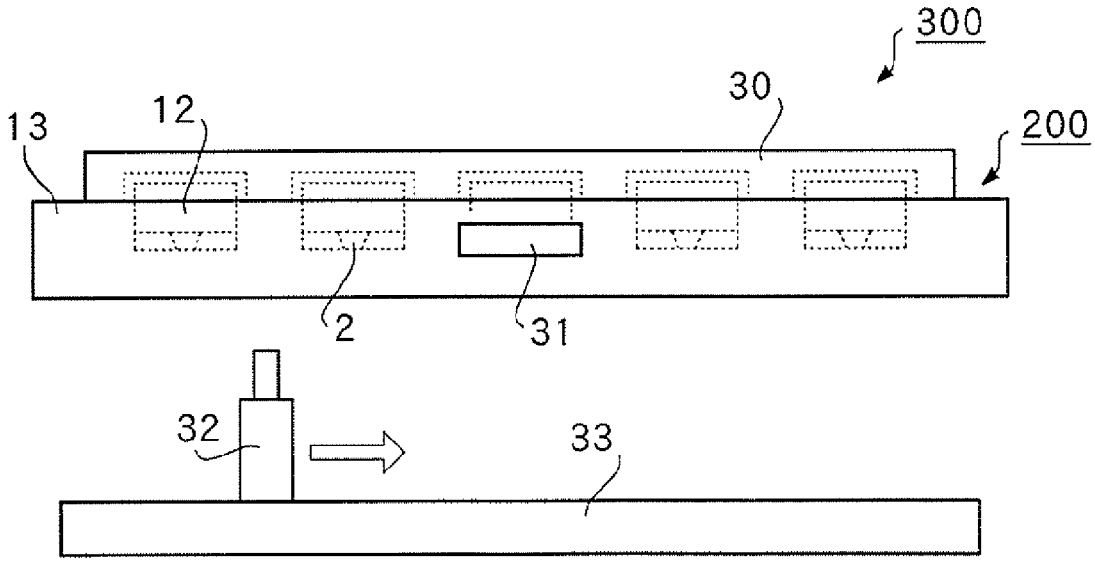
FIG. 14 is a schematic diagram showing a detection method for the nozzle pitch of an ink-jet recording apparatus according to Embodiment 4 of the present invention.

Next, the configuration of an ink-jet recording apparatus according to Embodiment 4 of the present invention will be described. FIG. 14 is a schematic diagram showing a detection method for the nozzle pitch of an ink-jet recording apparatus according to Embodiment 4 of the present invention.

As shown in FIG. 14, according to the detection method for the nozzle pitch of an ink-jet recording apparatus 200 of this example, the position of a nozzle 2 is read optically by means of a camera 32 functioning as a nozzle pitch detection section, and nozzle pitch P of nozzles 2 is measured thereby.

Camera 32 is supported by a camera moving section 33 so as to be able to move in the direction of the row of nozzles 2.

In FIG. 14, according to the detection method for the nozzle pitch of ink-jet recording apparatus 300 of this example, camera 32 is first moved by means of camera moving section 33 to the position of the endmost nozzle 2 of the row of nozzles 2 formed in ink discharge units 12.

Then, according to this method, camera 32 is moved to the position of the adjacent nozzle 2, and nozzle pitch P is detected by measuring the amount of this movement.

Depending on the case, a method may also be satisfactorily used whereby nozzle pitch P is found by measuring the spacing of both ends of the row of nozzles 2 formed in ink discharge units 12.

Then, according to this method, the value of nozzle pitch P obtained by means of the above-described method, the value of nozzle pitch P desired when using ink-jet head 200, and the coefficient of linear thermal expansion of head plate 13 are considered, the temperature to be maintained for ink-jet head 200 is determined, current is passed through heater 30, and head plate 13 is heated to and maintained at the desired temperature in accordance with the temperature detected by thermistor 31.

By this means, the desired nozzle pitch P can be obtained when ink-jet head 200 is used.

In ink-jet recording apparatus 300 of this example, nozzle pitch P of ink-jet head 200 is detected, the temperature to be maintained for head plate 13 is set based on that value, and thermal expansion of head plate 13 is caused, and the desired nozzle pitch P obtained, by having head plate 13 heated to and maintained at the set temperature by heater 30.

Therefore, with ink-jet recording apparatus 300 of this example, the desired nozzle pitch P can be dependably obtained even if nozzle pitch P varies for each ink-jet head 200.

With ink-jet recording apparatus 300 of this example, a method can also be used satisfactorily whereby current is passed through heater 30 while measuring nozzle pitch P, and when the desired nozzle pitch P is obtained, that temperature is maintained.

With ink-jet recording apparatus 300 of this example, camera 32 is moved by means of camera moving section 33, but it is also possible to keep camera 32 fixed and move ink-jet head 200.

Embodiment 5

Figure 15A:
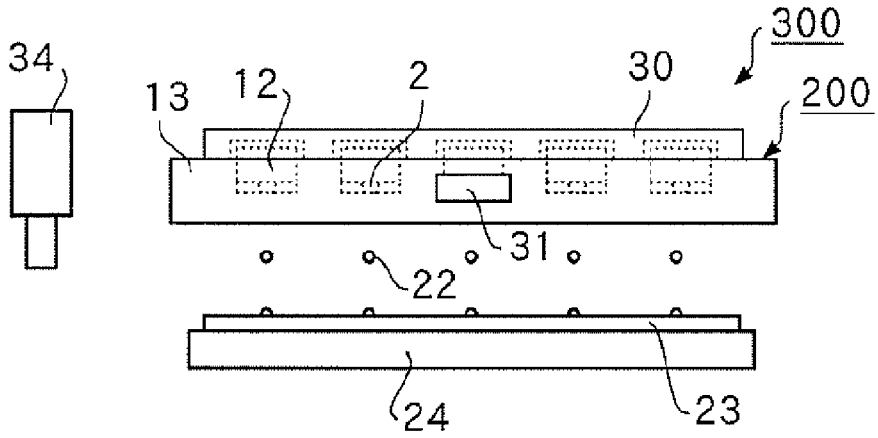
FIG. 15A is a schematic diagram showing another detection method for the nozzle pitch of an ink-jet recording apparatus according to Embodiment 5 of the present invention.

Next, another method of detecting nozzle pitch P of ink-jet recording apparatus 300 of this example will be described. FIG. 15A is a schematic diagram showing another detection method for the nozzle pitch of an ink-jet recording apparatus according to Embodiment 5 of the present invention, and FIG. 15B is a schematic diagram showing the operation of another detection method for the nozzle pitch of an ink-jet recording apparatus according to Embodiment 5 of the present invention.

Figure 15B:
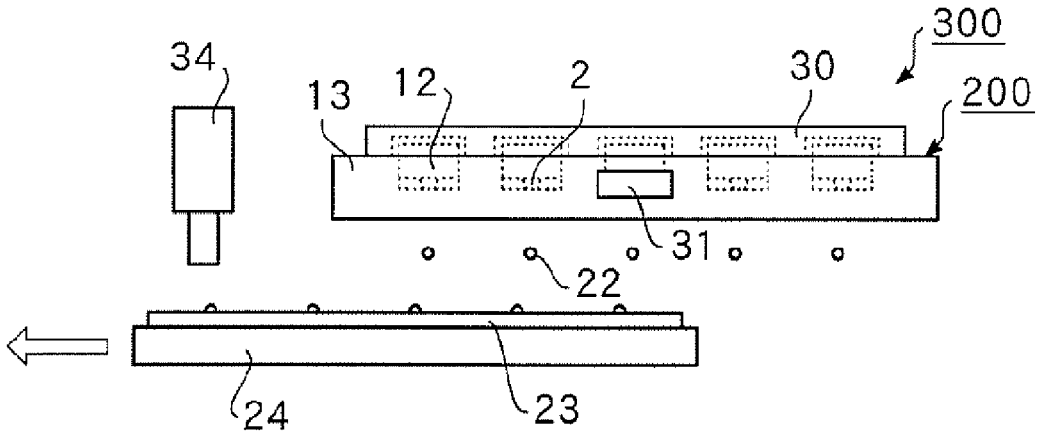
FIG. 15B is a schematic diagram showing the operation of another detection method for the nozzle pitch of an ink-jet recording apparatus according to Embodiment 5 of the present invention.

The difference between this nozzle pitch P detection method and the nozzle pitch P detection method shown in FIG. 14 is that the position of a nozzle 2 is not read directly by means of camera 32 as shown in FIG. 14, but instead, ink drops 22 are discharged from nozzles 2 as shown in FIG. 15A, and nozzle pitch P is detected by reading the impact positions of those ink drops 22 by means of a camera 34 as shown in FIG. 15B.

In FIG. 15A, receiving body 23 comprising paper, resin film, or the like, is used, ink drops 22 are discharged onto this receiving body 23, impact on receiving body 23, and form ink drop 22 images.

Then receiving body 23 on which ink drop 22 images have been formed is passed directly beneath a camera 34 in the direction indicated by the arrow in FIG. 15B, and the impact positions are read. Nozzle pitch P can then be read from these impact positions.

With this detection method, the nozzle pitch of ink-et head 200 is detected, the temperature to be maintained for head plate 13 is set based on that value, and thermal expansion of head plate 13 is caused, and the desired nozzle pitch obtained, by having head plate 13 heated to and maintained at the set temperature by heater 30.

Thus, with this detection method, an ink-jet recording apparatus 300 can be provided that enables the desired nozzle pitch P to be dependably obtained even if nozzle pitch P varies for each ink-jet head 200.

Embodiment 6

Figure 16:
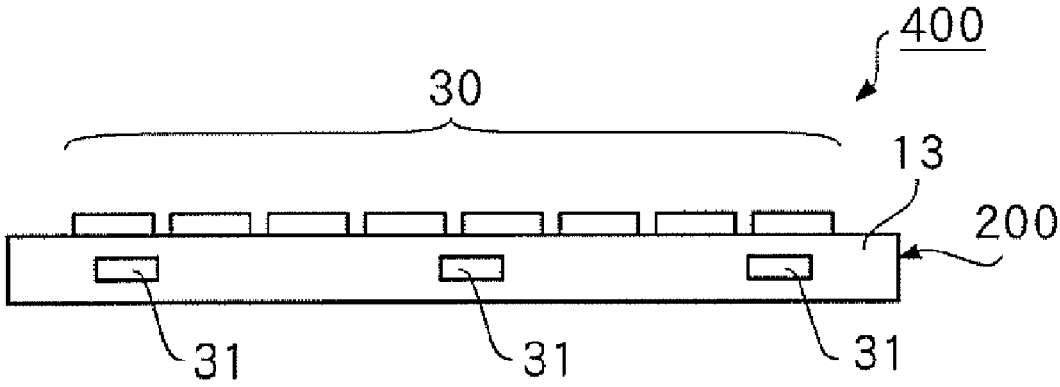
FIG. 16 is a front view showing the general configuration of an ink-jet recording apparatus according to Embodiment 6 of the present invention.

Next, an ink-jet recording apparatus according to Embodiment 6 of the present invention will be described. FIG. 16 is a front view showing the general configuration of an ink-jet recording apparatus according to Embodiment 6 of the present invention.

As shown in FIG. 16, an ink-jet recording apparatus 400 of this example differs from ink-jet recording apparatus 300 shown in FIG. 12 in being equipped with a plurality of heaters 30 and thermistors 31. For the sake of clarity, ink discharge units 12 are not shown in FIG. 16.

In FIG. 16, plurality of heaters 30 are configured so that current can be passed through each individually, making it possible to provide a flexible heat generation distribution in the direction of the row of ink-jet head 200 nozzles. Also, by providing a plurality of thermistors 31, it is also possible to measure the heat generation distribution in the direction of the row of ink-jet head 200 nozzles 2.

There are various demands with regard to nozzle pitch P of ink-jet head 200, and when ink-jet head 200 is actually manufactured, various problems arise concerning nozzle pitch P of ink-jet head 200.

One such problem is the desire to provide an ink-jet head 200 nozzle pitch P distribution within ink-jet head 200. This is a requirement of receiving body 23 onto which ink drops 22 are discharged, with, for example, nozzle pitch P at each end being made slightly longer than nozzle pitch P in the center.

This problem can be solved by making the calorific value of heaters 30 at both ends of ink-jet head 200 greater than the calorific value of heater 30 in the center, thereby raising the temperature at both ends of ink-jet head 200 above the temperature in the center, and increasing thermal expansion accordingly.

By this means, it is possible to make nozzle pitch P at each end of ink-jet head 200 longer than nozzle pitch P in the center.

Another problem is that, when ink-jet head 200 is manufactured, distribution may occur with respect to the desired value of nozzle pitch P within ink-jet head 200.

To solve this problem, it is desirable for heaters 30 to be given a heat generation distribution, and for ink-jet head 200 to be given a temperature distribution so as to correct the distribution with respect to the desired value.

A further problem is that, when there is an ink-jet head 200 calorific value distribution or a difference in heat dissipation according to ink-jet head 200 locations, if uniform heat generation is performed by heaters 30, a temperature distribution occurs in the ink-jet head, and as a result, a nozzle pitch distribution occurs.

To solve this problem, it is desirable for heaters 30 to be given a suitable heat generation distribution even if there is a calorific value distribution in ink-jet head 200, for instance, and thereby make the temperature of ink-jet head 200 uniform, and obtain a uniform nozzle pitch.

In ink-jet recording apparatus 400 of this example, it is possible to provide a temperature distribution in the direction of the row of ink-jet head 200 nozzles 2 by using a plurality of heaters 30 and creating a heat generation distribution.

By this means, with ink-jet recording apparatus 400 of this example, when there is an ink-jet head 200 nozzle pitch P distribution within that ink-jet head 200 and it is wished to eliminate that distribution, or conversely, when it is wished to provide a distribution for nozzle pitch P within ink-jet head 200, the desired nozzle pitch P can be obtained by providing a temperature distribution corresponding thereto.

Also, with ink-jet recording apparatus 400 of this example, by using a plurality of heaters 30 and providing a heat generation distribution for ink-jet head 200, if there is a calorific value distribution in ink-jet head 200 when ink-jet head 200 is heated and its temperature maintained, or if there are differences in ink-jet head 200 heat dissipation, by providing heaters 30 with a heat generation distribution corresponding thereto it is possible to perform heating and temperature maintenance so that the temperature of ink-jet head 200 becomes constant, and the desired nozzle pitch P can be obtained throughout ink-jet head 200.

Ink-jet recording apparatus 400 of this example is equipped with a plurality of heaters 30 in order to provide a heat generation distribution, but as long as a heat generation distribution can be provided, it is also possible, for example, to use a single heater 30 that has a heat generation distribution in order to obtain the desired heat generation distribution. In this case, of course, the heat generation distribution cannot be freely changed.

Also, with ink-jet recording apparatus 400 of this example, when ink-jet head 200 is provided with a temperature distribution, it is also possible to change the waveform applied to the respective piezoelectric elements 10 according to that temperature distribution, and also provide a distribution for the voltage applied to the ink in the respective ink discharge units 12.

Embodiment 7

Figure 17:
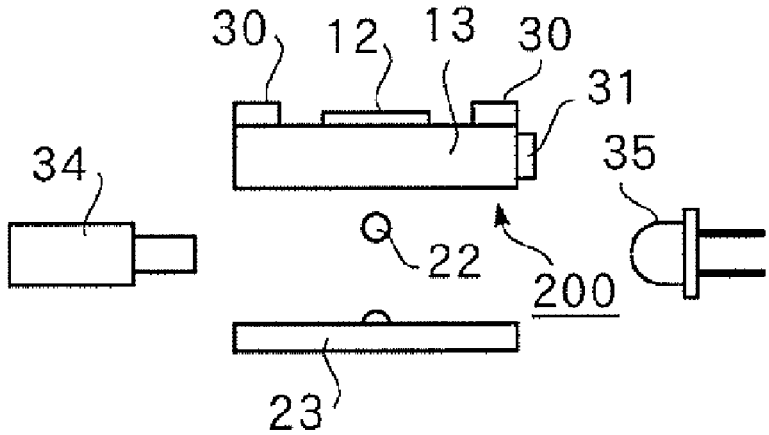
FIG. 17 is a front view showing a manufacturing method of an ink-jet head according to Embodiment 7 of the present invention.

Next, a manufacturing method of an ink-jet head according to Embodiment 7 of the present invention will be described. FIG. 17 is a front view showing a manufacturing method of an ink-jet head according to Embodiment 7 of the present invention.

As shown in FIG. 17, according to the manufacturing method of ink jet head 200 of this example, heater 30 and thermistor 31 used for ink-jet recording apparatus 300 are also provided when an ink discharge unit 12 is fitted to head plate 13.

In FIG. 17, in the manufacturing method of ink-jet head 200 of this example, before ink discharge unit 12 is aligned with head plate 13, head plate 13 is first heated to and maintained at the temperature at which ink-jet head 200 is actually used, using heater 30 and thermistor 31.

Thereafter, the same kind of operations are performed as in the manufacturing method shown in FIG. 9, and ink discharge unit 12 is aligned with and fixed to head plate 13.

According to the manufacturing method of ink-jet head 200 of this example, head plate 13 is kept at the temperature at which ink-jet head 200 will finally be used, and alignment of ink discharge unit 12 with head plate 13 is carried out in this state.

Therefore, according to the manufacturing method of ink-jet head 200 of this example, an ink-jet head 200 can be obtained in which thermal expansion and contraction of head plate 13 is not considered at all, and the desired nozzle pitch P can be obtained as long as the temperature of head plate 13 is kept constant during use.

Also, according to the manufacturing method of ink-jet head 200 of this example, the same heater 30 is used when an ink discharge unit 12 is aligned and when ink-jet recording apparatus 300 is actually used, and head plate 13 temperature irregularities and variations are approximately the same in both cases.

Therefore, with the manufacturing method of ink-jet head 200 of this example, even if there are temperature irregularities or variations in head plate 13 when an ink discharge unit 12 is aligned, as long as ink discharge unit 12 is aligned satisfactorily in that state, the desired nozzle pitch P can be obtained, and an ink-jet head 200 with good ink drop 22 impact positioning capability can be provided.

In this embodiment, it has been assumed that the same kind of alignment and fixing method as in Embodiment 5 is used after performing heating and temperature maintenance of head plate 13, but the same kind of alignment and fixing method as in Embodiment 1 may also be used.

With the manufacturing method of ink-jet head 200 of this example, heater 30 utilized in ink-jet recording apparatus 300 is ultimately used to change the temperature of head plate 13, but there may be cases where, although this is desirable from the standpoint of impact positioning capability, temperature changing by a different means is desirable from the standpoint of efficiency of the manufacturing process.

In such cases, it is possible, for example, to use a separate high-output heater, or to change not only the temperature of head plate 13 but also the surrounding environmental temperature.

An above-described ink discharge unit 12 is provided with one nozzle plate 1 in which a single nozzle 2 is formed.

Figure 18A:
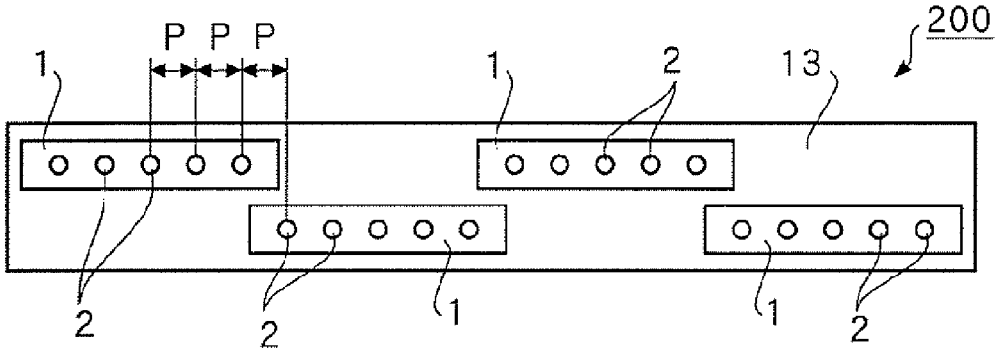
FIG. 18A is a front view showing another manufacturing method of an ink-jet head according to Embodiment 7 of the present invention.
Figure 18B:
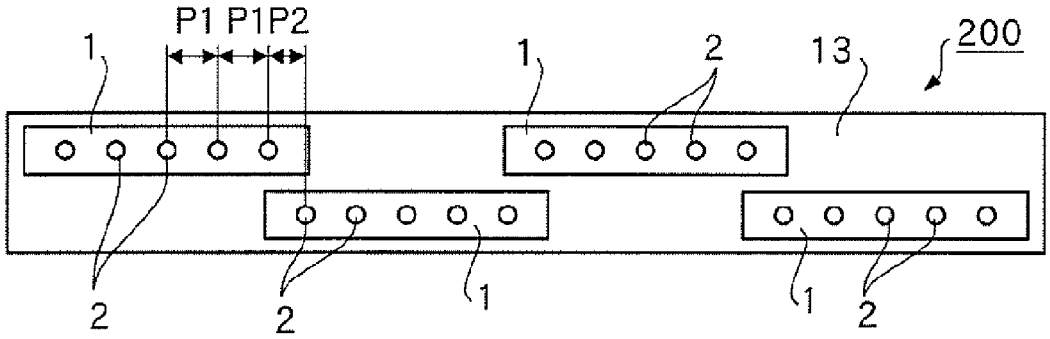
FIG. 18B is a plan view showing the general configuration after heating in another manufacturing method of an ink-jet head according to Embodiment 7 of the present invention.

If, on the other hand, one nozzle plate 1 of one ink discharge unit 12 is provided with a plurality of nozzles 2, as shown in FIG. 18A and FIG. 18B, for example, since the amount of thermal expansion and contraction of head plate 13 and the amount of thermal expansion and contraction of ink discharge unit 12 differ, there is a difference between initial-state nozzle pitch P shown in FIG. 18A and post-heating nozzle pitch P2 shown in FIG. 18B at the junctures of the ink discharge units 12.

Thus, in the manufacturing method of ink-jet head 200 of this example, the temperature of head plate 13 is controlled at the desired temperature, and the length of head plate 13 is changed to the desired length by causing thermal expansion or contraction of head plate 13.

By this means, with the manufacturing method of ink-jet head 200 of this example, nozzle pitch P of each nozzle 2 of each ink discharge unit 12 fixed to head plate 13 can be controlled to the desired nozzle pitch P.

Ink-jet head 200 of this example may be configured so that a plurality of nozzles 2 are provided for one pressure chamber 6, and may be configured so that ink drops 22 are always discharged simultaneously from a plurality of nozzles 2 for forming one pixel.

The present application is based on Japanese Patent Application No. 2005-032555 filed on Feb. 9, 2005, and Japanese Patent Application No. 2005-137032 filed on May 10, 2005, entire content of which is expressly incorporated herein by reference.

INDUSTRIAL APPLICABILITY

An ink-jet head of the present invention enables ink suction from a nozzle to be performed dependably when an ink-jet head is filled with ink, and when a recovery operation is performed in the event of a discharge defect, and not only records text or images by discharging ink onto recording paper, but can be applied to industrial uses such as formation of a wiring pattern by discharging various kinds of metallic ink, color filter formation by discharging a color filter material, discharge of various kinds of material for performing EL (electroluminescence), and discharge of various kinds of material for organic TFT creation, for example.

What is claimed is:

1. An ink-jet head for providing stable ink discharge, comprising:

a plurality of ink discharge units, each of said plurality of discharge units including:

a nozzle plate in which a nozzle that discharges ink is formed;

a pressure application section that applies pressure to ink and includes a diaphragm that moves relative to said nozzle plate, wherein said diaphragm moves in a direction approximately parallel to a discharge direction of an ink drop discharged from said nozzle; and a nozzle plate holding member that holds said nozzle plate;

a head plate that holds said plurality of ink discharge units;

a sealing member that seals a gap between each of said plurality of ink discharge units and said head plate so that air does not pass through and that elastically supports each of said plurality of ink discharge units with respect to said head plate; and a fixing member that fixes each of said plurality of ink discharge units and said head plate so as to maintain alignment of said ink discharge unit with said head plate.

2. The ink-jet head according to claim 1, wherein said fixing member fixes each of said plurality of ink discharge units to said head plate in an attachable and removable fashion.

3. The ink-jet head according to claim 1, wherein said pressure application section further comprises a piezoelectric element that drives said diaphragm.

4. An ink-jet recording apparatus comprising:

the ink-jet head according to claim 1; and a nozzle pitch detection section that detects spacing of said nozzles of said plurality of ink discharge units.

5. A manufacturing method of the ink-jet head according to claim 1, wherein:

said ink drop is discharged from each of said plurality of ink discharge units; and alignment of each of said plurality of ink discharge units and said head plate is performed while discharging an ink drop from at least one of said plurality of ink discharge units and observing a state of flight of the ink drop discharged from at least one of said plurality of ink discharge units.

6. An ink-jet head for providing stable ink discharge, comprising:

a plurality of ink discharge units, each of said plurality of discharge units including:

a nozzle plate in which a nozzle that discharges ink is formed;

a pressure application section that applies pressure to ink; and a nozzle plate holding member that holds said nozzle plate;

a head plate that holds said plurality of ink discharge units;

a sealing member that seals a gap between each of said plurality of ink discharge units and said head plate so that air does not pass through and that elastically supports each of said plurality of ink discharge units with respect to said head plate; and a fixing member that fixes each of said plurality of ink discharge units and said head plate so as to maintain alignment of said ink discharge unit with said head plate, wherein:

said head plate has an aperture part through which an ink drop discharged from at least one of said plurality of ink discharge units passes, and ink repellence processing is performed on at least part of a surface of said head plate on a side of said head plate on which said ink drop is discharged.

7. An ink-jet head for providing stable ink discharge, comprising:

a plurality of ink discharge units, each of said plurality of discharge units including:

a nozzle plate in which a nozzle that discharges ink is formed;

a pressure application section that applies pressure to ink; and a nozzle plate holding member that holds said nozzle plate;

a head plate that holds said plurality of ink discharge units;

a sealing member that seals a gap between each of said plurality of ink discharge units and said head plate so that air does not pass through and that elastically supports each of said plurality of ink discharge units with respect to said head plate; and a fixing member that fixes each of said plurality of ink discharge units and said head plate so as to maintain alignment of said ink discharge unit with said head plate, wherein:

said head plate has an aperture part through which an ink drop discharged from at least one of said plurality of ink discharge units passes, and ink repellence processing is performed on wall surface of said aperture part that is not in contact with said sealing member on a side of said head plate on which said ink drop is discharged.

8. An ink-jet head for providing stable ink discharge, comprising;

a plurality of ink discharge units, each of said plurality of discharge units including:

a nozzle plate in which a nozzle that discharges ink is formed;

a pressure application section that applies pressure to ink; and a nozzle plate holding member that holds said nozzle plate;

a head plate that holds said plurality of ink discharge units;

a sealing member that seals a gap between each of said plurality of ink discharge units and said head plate so that air does not pass through and that elastically supports each of said plurality of ink discharge units with respect to said head plate;

a fixing member that fixes each of said plurality of ink discharge units and said head plate so as to maintain alignment of said ink discharge unit with said head plate; and a temperature changing section that changes a temperature of said head plate, wherein when said temperature changing section changes a temperature of said head plate, thermal expansion and contraction of said head plate occurs, and spacing of said nozzles of said plurality of ink discharge units is maintained at a predetermined value.

9. The ink-jet head according to claim 8, wherein a temperature distribution is provided in a direction of a row of said nozzles of said plurality of said ink discharge units by said temperature changing section.

10. The ink-jet head according to claim 8, wherein pressure applied by said pressure application section changes in accordance with the temperature of said head plate.

11. The ink-jet head according to claim 8, wherein said temperature changing section is a heater that generates heat through passage of electric current and is attached to said head plate.

12. The ink-jet head according to claim 11, wherein said heater has a heat generation distribution with respect to said head plate.

13. The ink-jet head according to claim 8, wherein each of said ink discharge units is fixed to said head plate in an attachable and removable fashion.

14. The ink-jet head according to claim 8, wherein each of said plurality of ink discharge units is provided with only one nozzle plate in which only one said nozzle is formed.

15. A manufacturing method of the ink-jet head according to claim 8, wherein when a temperature of said head plate during use of said ink-jet head is T1, and a nozzle pitch of said plurality of ink discharge units at said temperature T1 is P1, and a nozzle pitch of said plurality of ink discharge units changes to P2 when the temperature of said head plate is changed to T2 by said temperature changing section, alignment of each of said plurality of ink discharge units and said head plate is performed so that the nozzle pitch of said plurality of ink discharge units becomes P2 at said temperature T2.

16. A manufacturing method of the ink-jet head according to claim 8, wherein alignment of each of said plurality of ink discharge units and said head plate is performed in a state in which said ink-jet head is maintained at a temperature at which said ink-jet head is operated by using said temperature changing section.

* * * * *